US006086337A

United States Patent [19]

Watanabe et al.

[11] Patent Number: 6,086,337

[45] Date of Patent: Jul. 11, 2000

[54] VARIABLE CAPACITY PUMP

[75] Inventors: Yasushi Watanabe; Hideaki Ohnishi, both of Atsugi, Japan

[73] Assignee: Unisia Jecs Corporation, Atsugi, Japan

[21] Appl. No.: 09/121,119

[22] Filed: Jul. 23, 1998

Related U.S. Application Data

[62] Division of application No. 08/797,638, Feb. 7, 1997, Pat. No. 5,797,732, which is a continuation of application No. 08/365,148, Dec. 28, 1994, abandoned.

[30] Foreign Application Priority Data

Dec. 28, 1993 [JP] Japan ..... 5-70797
Feb. 22, 1994 [JP] Japan ..... 6-24166

[51] Int. Cl.[7] ..... F02C 15/04; F02C 2/10

[52] U.S. Cl. ..... 417/310; 417/302; 417/304

[58] Field of Search ..... 417/310, 308, 417/302, 304, 296, 297, 504; 137/115; 418/15, 171

[56] References Cited

U.S. PATENT DOCUMENTS

| | | | |
|---|---|---|---|
| 2,389,728 | 11/1945 | Hill | 74/462 |
| 2,830,542 | 4/1958 | Erickson et al. | 103/126 |
| 3,267,864 | 8/1966 | Eddy | 417/304 |
| 3,454,031 | 7/1969 | Kaptur | 137/115 |
| 3,536,426 | 10/1970 | Albrecht et al. | 418/166 |
| 3,561,328 | 2/1971 | Stremple | 137/115 |
| 3,953,153 | 4/1976 | Huber et al. | 417/310 |
| 4,255,093 | 3/1981 | Erikson | 417/310 |
| 4,412,789 | 11/1983 | Ohe et al. | 417/299 |
| 4,597,718 | 7/1986 | Nakano et al. | 417/304 |
| 4,658,583 | 4/1987 | Shropshire | 418/171 |
| 5,114,325 | 5/1992 | Morita | 418/171 |
| 5,226,802 | 7/1993 | Nakamura et al. | 417/299 |
| 5,289,681 | 3/1994 | Iwata | 137/115 |
| 5,797,732 | 8/1998 | Watanabe et al. | 417/310 |

FOREIGN PATENT DOCUMENTS

| | | |
|---|---|---|
| 636363 | 2/1962 | Canada . |
| 4308506 | 9/1993 | Germany . |
| 1781 | 1/1988 | Japan . |
| 4-3238291 | 10/1991 | Japan . |
| 405240166 | 9/1993 | Japan . |
| 1 316 934 | 5/1973 | United Kingdom . |
| 2 085 969 | 5/1982 | United Kingdom . |

OTHER PUBLICATIONS

The Aircraft Gas Turbine Engine and Its Operation, Pratt and Whitney Aircraft, 105–107, Jun. 1974.
"Motorfan", Sep. 1991, p. 182.

*Primary Examiner*—Ted Kim
*Attorney, Agent, or Firm*—Foley & Lardner

[57] ABSTRACT

An oil pump effects a pumping action to deliver oil from an inlet port to a first outlet port and also to a second outlet port. An oil supply passage is connected to the second outlet port. A regulator valve has a bore, a spool disposed in the bore, a pressure chamber, and a pressure admission port connected to the oil supply passage and communicating with the pressure chamber. A branch passage connected to the oil supply passage opens to the bore. The regulator valve also has relief port connected to the inlet port and opening to the bore, and a transfer port connected to the first outlet port. The spool disposed in the bore is moveable responsive to pressure within the pressure chamber between a first position in which the transfer port is connected to the branch passage and a second position in which the transfer port is connected to the relief port.

5 Claims, 6 Drawing Sheets

VARIABLE CAPACITY PUMP

This application is a divisional of application Ser. No. 08/797,638, filed Feb. 7, 1997 now U.S. Pat. No. 5,797,732 which is a continuation of application Ser. No. 08/365,148, filed Dec. 28, 1994, now abandoned.

BACKGROUND OF THE INVENTION

The present invention relates to a variable capacity pump for an internal combustion engine.

A variable capacity pump is well known and used in automotive vehicles. One of them is illustrated on page 182 of a periodical magazine "Motorfan" published in September 1991.

According to this variable capacity pump, a regulator valve has a transfer port connected to a first low pressure pump outlet port, relief ports, an inlet port connected to a second high pressure pump outlet port, and a lubricating oil supply port to the engine. The regulator valve uses a pressure responsive spool formed with an axial passage and a radial passage in order to deliver oil from the inlet port to a pressure chamber. The spool is moveable in response to pressure within the pressure chamber to connect the transfer port to one of the outlet ports or connect the transfer port to the relief port or connect the inlet port to the other relief ports.

An object of the present invention is to provide an alternative to the variable capacity pump.

SUMMARY OF THE INVENTION

According to the present invention, there is provided a variable capacity pump, comprising:

means having an inlet port, a first outlet port and a second outlet port, for pumping oil from said inlet port to said first outlet port and also to said second outlet port;

an oil supply passage connected to said second outlet port of said pumping means;

a regulator valve having bore means and pressure responsive means defining In said bore means a pressure chamber and a pressure admission port connected to said oil supply passage and communicating with said pressure chamber; and a branch passage connected to said oil supply passage;

said regulator valve having relief port means connected to said inlet port, and a transfer port connected to said first outlet port of said pumping means;

said pressure responsive means including a spool disposed in said bore means and moveable responsive to pressure within said pressure chamber between a first position in which said transfer port is connected to said branch passage and a second position in which said transfer port is connected to said relief port means.

DETAILED DESCRIPTION OF THE INVENTION

Figure 1:
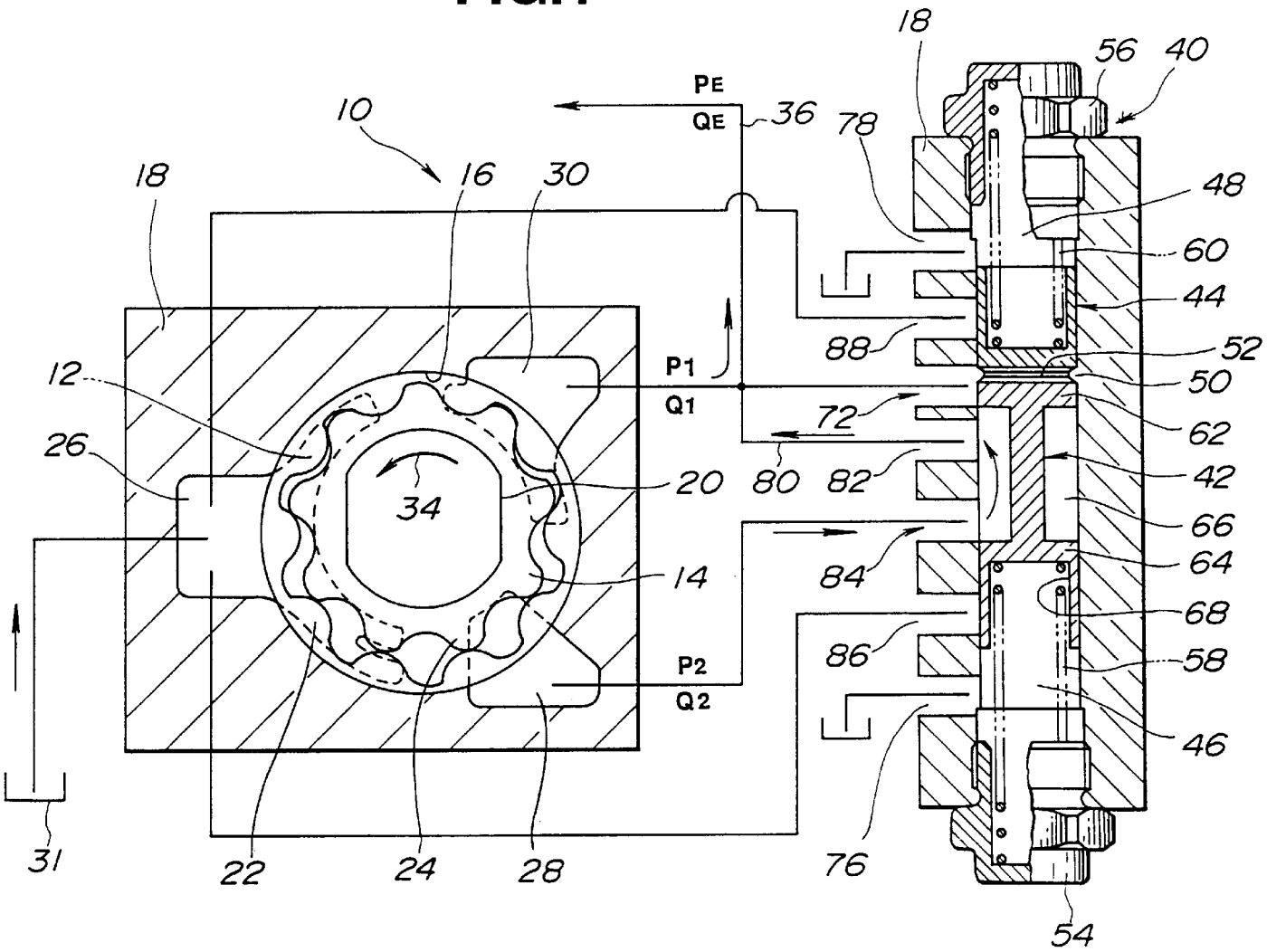
FIG. 1 is a circuit diagram of a variable capacity pump in accordance with the present invention, showing the position of parts during operation at speeds not higher than a first predetermined speed value.

Referring to FIG. 1, the variable capacity pump is generally denoted by the reference numeral 10. The pump 10 comprises an outer rotor 12 and an inner rotor 14 which is driven to rotate about an axis offset from the axis of the outer rotor. The outer and inner rotors 12 and 14 are mounted in a pocket 16 in the wall of the cylinder block 18 of an internal combustion engine. The inner rotor 14 has generally rectangular hole and is driven by being engaged on a corresponding generally rectangular shaft 20 of the engine, which shaft projects into the pocket 16. The outer rotor 12 has lobes 22 and the inner rotor 14 has lobes 24, one fewer in number than lobes 22. Lobes 22 and 24 make eliding contact and pump lubricating oil from an inlet port 26 to both a first or low pressure outlet port 28 and a second or high pressure outlet port 30. Lubricating oil in an oil pan 31 of the engine is drawn from the inlet port 26 into gradually expanding spaces between the lobes 22 and 24 and is forced into the first outlet port 28 and then into the second outlet port 30 by the lobe spaces being progressively decreased in volume. The quantity of lubricating oil thus transported depends, among other things, on the speed of rotation of the inner rotor 14, the maximum volume of the lobe spaces and the capacity of inlet and outlet passages to fill and empty those spaces in the brief interval of time permitted. The first outlet port 28 opens into the pocket 16 at a portion on the leading side of the area at which the second outlet port 30 opens into the pocket 16 with respect to a direction of rotation of the inner rotor 14, the direction being indicated by an arrow 34. Thus, assuming that the pressure and flow rate at the first outlet port 28 and thoes at the second outlet port 30 are P2, Q2 and P1 and Q1, respectively, the relationship that P1>P2 and Q1>Q2 holds.

The variable capacity pump 10 has a lubricating oil supply passage 36 having one end connected to the second outlet port 30. Through the oil supply passage 36, lubricating oil is supplied to the engine.

The delivery pressure at which the oil is supplied to the engine is controlled by a regulator valve 40. The regulator valve 40 comprises a pressure responsive spool 42 and a pressure responsive piston 44 which are slidably mounted in axially aligned mutually opposed bores 46 and 48, respectively, formed in the wall of the cylinder block 18. The bores 46 and 48 are separated by an apertured partition wall in the form of a radial projection 50 defining an internal passage 52. Through this passage 52, the bores 46 and 48 are interconnected at their inner ends. At their outer or remotest ends, the bores 46 and 48 are closed by plugs 54 and 56, respectively. The plug 54 is threadedly engaged with the wall of the bore 46 and serves as a retainer of a return spring 58 for the spool 42, while the plug 56 is threadedly engaged with the wall of the bore 48 and serves as a retainer of a return spring 60 for the piston 44. The spool 42 has axially spaced lands 62 and 64 defining therebetween a sleeve-like lands space 66 in cooperation with the wall of the bore 46. The land 64 has a blind axial bore 68 opening toward the plug 54. The return spring 58 has one end bearing against the plug 54 and the opposite end bearing against the closed end of the blind bore 68, biasing the spool 42 against the radial projection 50. the piston 44 has a blind bore 70 opening toward the plug 56. The return spring 60 has one end bearing against the plug 56 and the opposite end bearing against the closed end of the blind bore 70, biasing the piston 44 against the radial projection 50.

Figure 2:
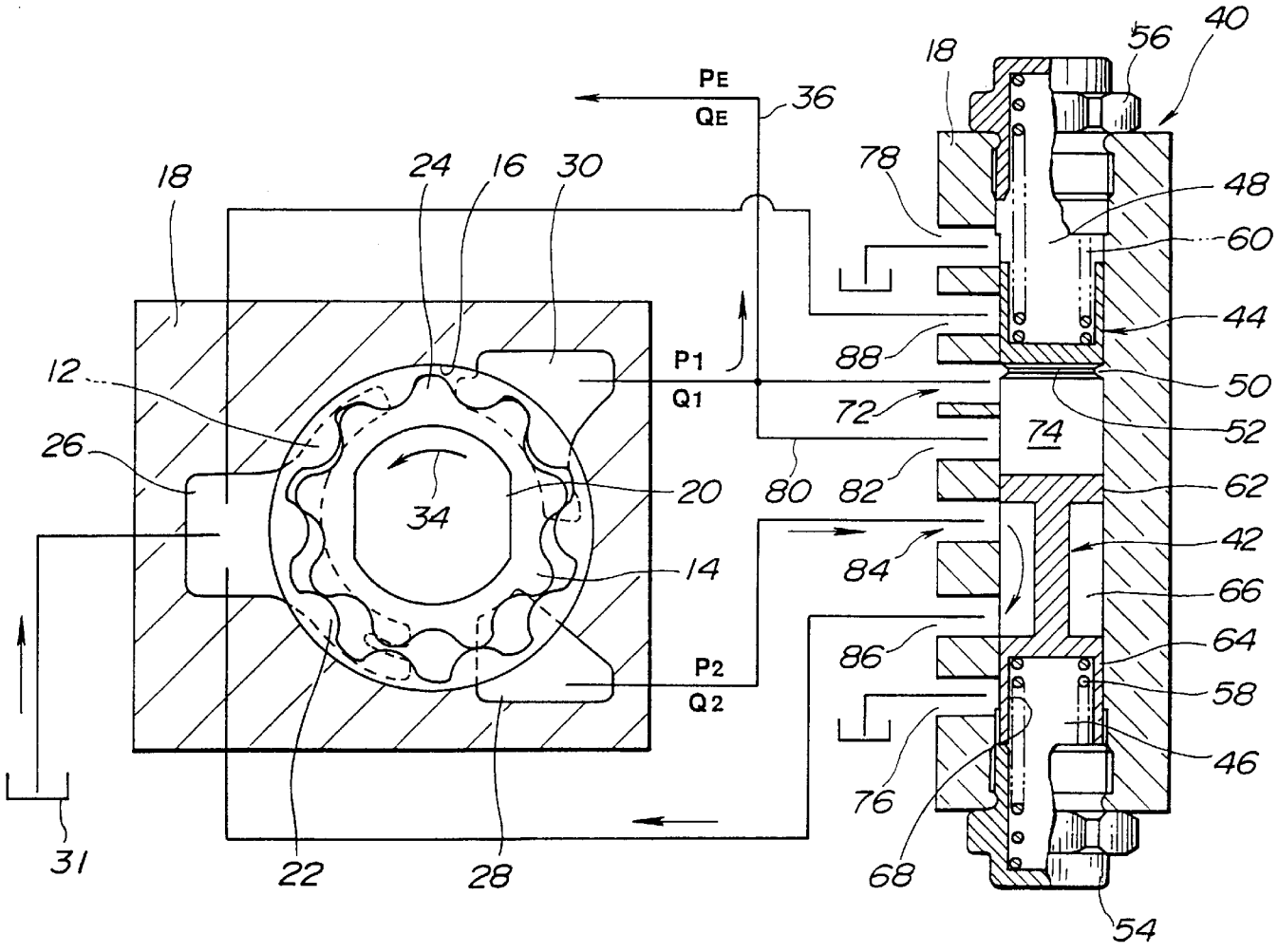
FIG. 2 is a similar view to FIG. 1, showing the position of parts during operation at speeds higher than the first predetermined speed value but not higher than a second predetermined speed value that is higher than the first predetermined speed value.
Figure 3:
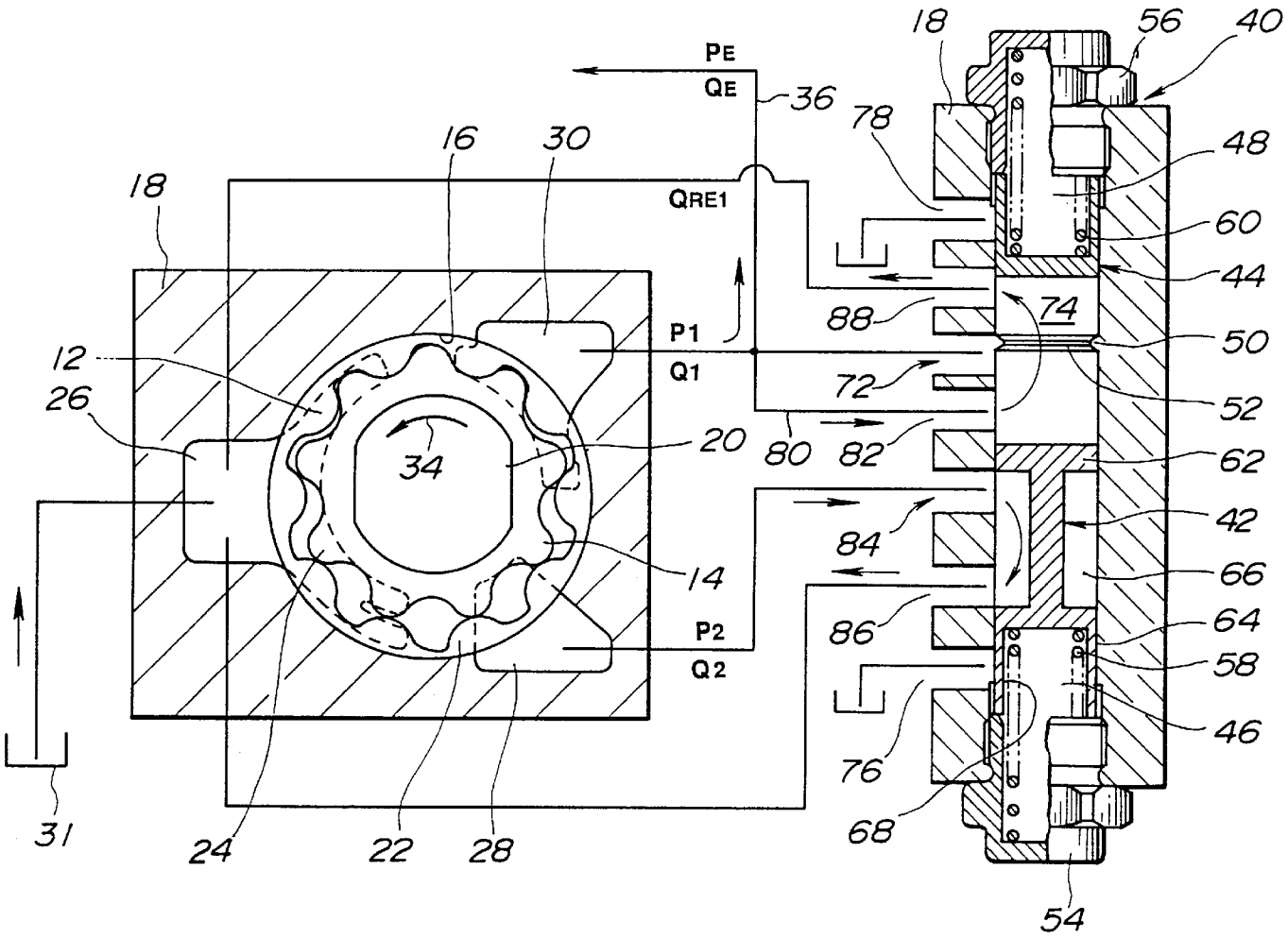
FIG. 3 is a similar view to FIG. 1, showing the position of parts during operation at speeds higher than the second predetermined speed value.

FIG. 1 shows the spool 42 and the piston 44 in their spring set positions, respectively. The internal passage 52 defined by the radial projection 50 is always connected to the lubricating oil supply passage 36 via a pressure admission radial port 72. The land 62 of the spool 42 and the piston 44 are separated and define therebetween a pressure chamber including the internal passage 52. The setting of the springs 58 and 60 is such that, in response to an increase in pressure within the internal passage 52, the spring 58 is compressed to allow movement of the spool 42 from the spring set position thereof to a second position thereof as illustrated in FIG. 2, causing the pressure chamber 74 to increase in volume, and, in response to a further increase in pressure within the pressure chamber 74, the spring 60 is compressed to allow movement of the piston 44 from the spring set position thereof as illustrated in FIGS. 1 and 2 to a second position thereof as illustrated in FIG. 3, causing a further increase in volume of the pressure chamber 74.

Two drain ports 76 and 78 open to the bores 46 and 48 to drain the spaces accommodating the return springs 58 and 60, respectively.

The variable capacity pump 10 comprises a branch passage 80 connected to the oil supply passage 36. The branch passage 80 serves as a part of a fluid path delivering oil from the first port 28 to the oil supply passage 36 when the regulator valve 40 is in the position as illustrated in FIG. 1 and serves as a part of a relief path returning excessive oil from the oil supply passage 36 to the inlet port 26 when the regulator valve is in the position illustrated in FIG. 3. In this embodiment, the branch passage 80 has a single port 82 opening to the bore 46 at such a position that, when the spool 42 is in the spring set position thereof (see FIG. 1), the port 82 communicates with the sleeve-like lands space 66 only, while, when the spool 42 is in the second position thereof (see FIGS. 2 and 3), the port 82 communicates with the pressure chamber 74 only.

A transfer port 84 connected to the first outlet port 28 opens to the bore 46 at such a position that, when the spool 42 is in the spring set position thereof (see FIG. 1), the transfer port 84 communicates with sleeve-like lands space 66 only which in turn communicates with the port 82 of the branch passage 80.

In this embodiment, two relief ports 86 and 88 open to the bores 46 and 48, respectively. The relief port 86 mates with the transfer port 84 only, while the relief port 88 mates with the port 82 of the branch passage 80 only. Both of the relief ports 86 and 88 are connected to the inlet port 26. The relief port 86 is covered by the land 64 of the spool 42 when the spool 42 is in the spring set position (see FIG. 1), but uncovered by the land 64 to communicate with the sleeve-like lands space 66 which in turn communicates with the transfer port 84 when the spool 42 is in the spring set position thereof (see FIGS. 2 and 3). The transfer port 88 is covered by the piston 44 when the piston is in the spring set position (see FIGS. 1 and 2), but is uncovered to communicate with the pressure chamber 74 which in turn communicates with the port 82 of the branch passage 80 when the piston 44 assumes the second position thereof (see FIG. 3).

Assuming that the pump speed, i.e., the rotation speed of shaft 20, is the engine speed, the variable capacity pump 10 takes the position shown in FIG. 1 when the engine speed is lower than the first predetermined speed value. Under this condition, oil with pressure P1 and flow rate Q1 is supplied from the second port 30 to the oil supply passage 36 and at the same time oil with pressure P2 and flow rate Q2 is supplied from the first outlet port 28 through the transfer port 84, sleeve-like lands space 66, port 82 and branch passage 80 to the oil supply passage 36. Thus, the pressure PE at which oil is supplied through the oil supply passage 36 to the engine is almost as high as the pressures P1 and P2 since both of these pressures are low, and the flow rate of oil QE supplied to the engine is the sum of Q1 and Q2.

When the variable capacity pump 10 takes the position as illustrated in FIG. 2 during operation of the engine at speeds higher than the first predetermined value, but not higher than the second predetermined value, all of the oil delivered to the transfer port 84 returns via the sleeve-like lands space 66 and the relief port 86 to the inlet port 26, and all of oil is supplied from the second outlet port 30 to the oil supply passage 36. Thus, the pressure PE is as high as P1 and QE is as high as Q1. As all of the oil delivered from the first outlet port 28 returns to the inlet port 26 without any flow resistance, the loss of engine power is minimized under this condition.

Assuming the engine speed further increases, when the variable capacity pump 10 takes the position as shown in FIG. 3 during operation of the engine at speeds higher than the second predetermined value, a portion of oil within the oil supply passage 36 returns through the bypass 80, port 82, pressure chamber 74 and relief port 88 to the inlet port 26.

According to this embodiment, the shift timing between the position shown in FIG. 1 and that shown in FIG. 2 and the shift timing between the position shown in FIG. 2 and the position shown in FIG. 3 can be easily adjusted to the engine characteristic by only replacing the return passages 58 and 60 with new ones.

Figure 4:
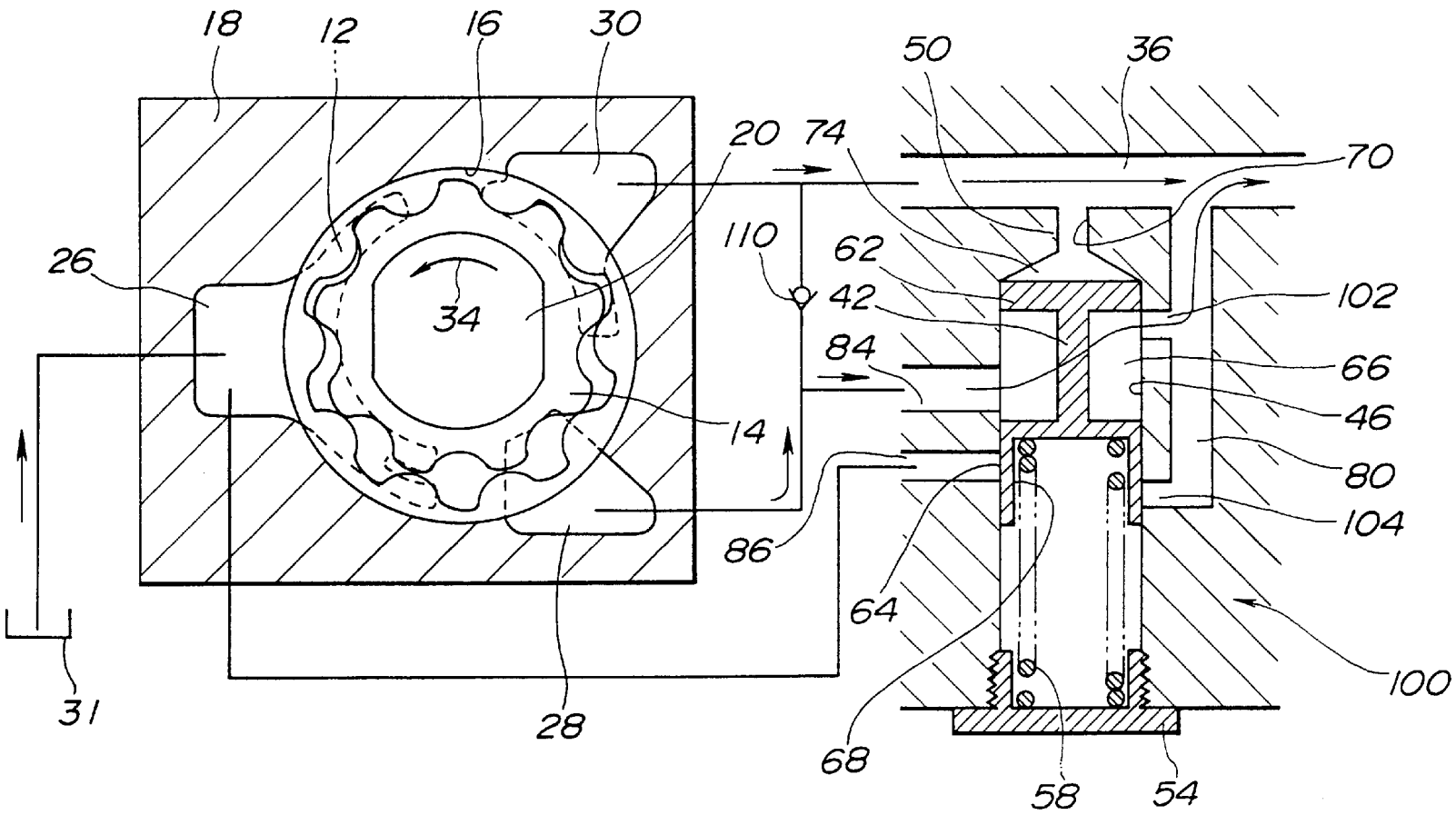
FIG. 4 shows a second embodiment of a variable capacity pump of the present invention, showing the position of parts during operation at speeds lower than the first predetermined speed value.

Referring to FIG. 4, the second embodiment is described. In this embodiment, a regulator valve which is the counterpart of the regulator valve 40 of the first embodiment is illustrated in a very simple manner. Since the second embodiment is substantially the same as the first embodiment, the same reference numerals as used in the first embodiment are used in this second embodiment to designate like or similar parts for the sake of simplicity in description.

The regulator valve which is now generally designated by the reference numeral 100 is not provided with the counterparts of the piston 44, bore 48 for the piston 44, plug 56, return spring 60 and drain port 78. In the second embodiment, a drain port equivalent to the drain 76 is not illustrated although it exits. There is the counterpart of the radial projection 50. However, the radial projection 50 of the second embodiment defines a pressure admission axial port 70 connected to a lubricating oil supply passage 36. The relief port 88 is not used and a single relief port 86 mates not only with a transfer port 84 connected to a first outlet port 28, but also with a branch passage 80. In the second embodiment, the branch passage 80 connected to the oil supply passage 36 has two axially spaced ports 102 and 104.

The port 102 mates with the transfer port 84 only (see FIG. 4), while the port 104 mates with the single relief port 86 only, as different from the first embodiment in which the single port 82 of the branch passage 80 mates not only with the transfer port 84 but also with the relief port 88.

The variable capacity pump 100 comprises a one-way check valve 110 which is arranged between the first outlet port 28 and the oil supply passage 36 to allow escape of oil to the oil supply passage 36 when both of the ports 102 and 104 of the bypass 80 are covered by lands 62 and 64 of a spool 42 (see FIG. 5) and the transfer port 84 is blocked.

Figure 5:
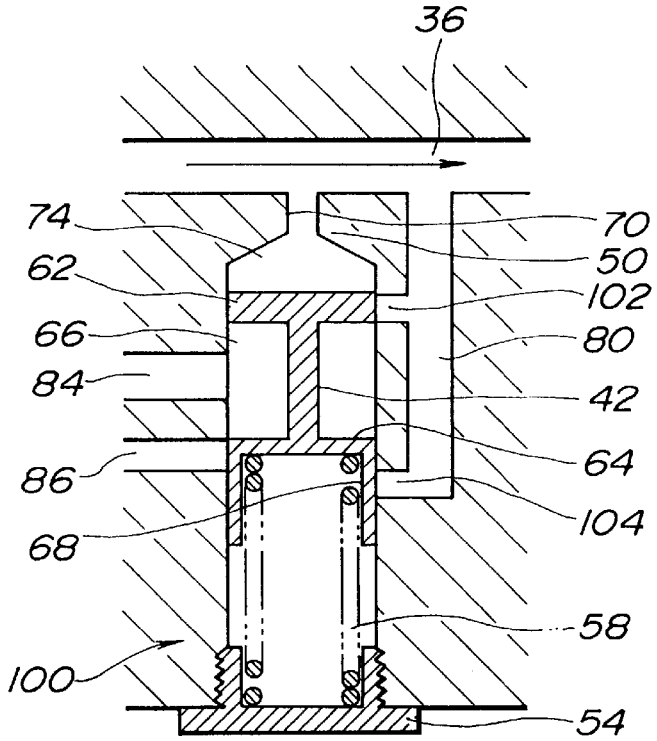
FIG. 5 is a fragmentary view of FIG. 4 showing the position of parts during operation at speeds higher than the first predetermined value but not higher than an intermediate speed value that is higher than the first predetermined speed value but not higher than the second predetermined speed value.
Figure 6:
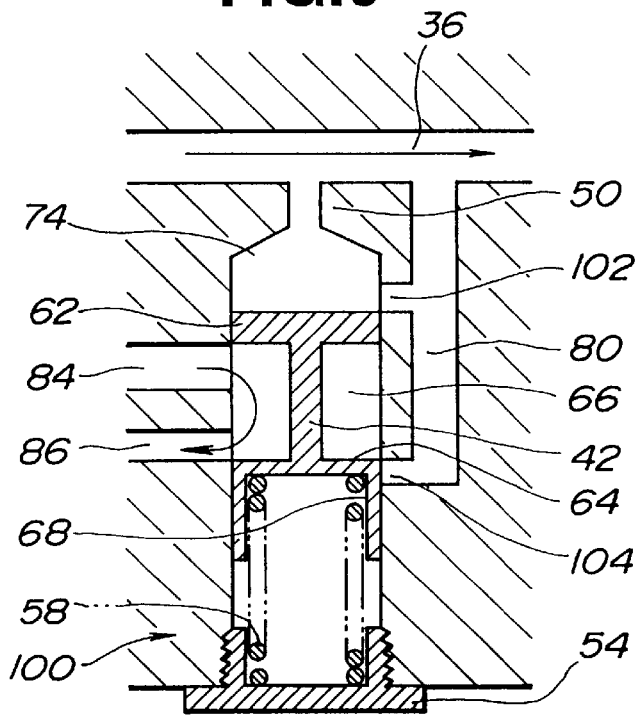
FIG. 6 is the fragmentary view, showing the position of parts during operation at speeds higher than the intermediate speed value but not higher than the second predetermined value.
Figure 7:
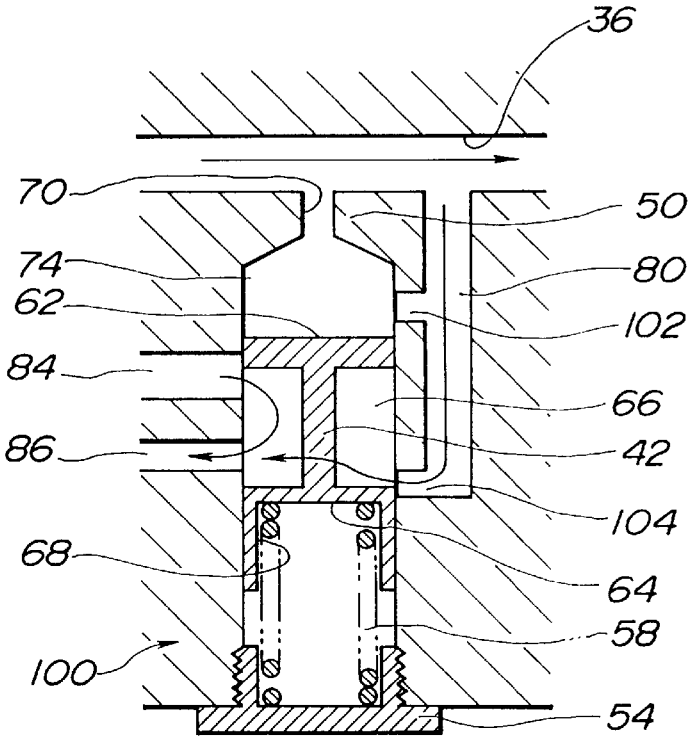
FIG. 7 is the fragmentary view, showing the position of parts during operation at speeds higher than the second predetermined speed values

Depending on pressure increase within a pressure chamber 74, the spool 42 moves against the bias of a return spring 58 from a spring set position (see FIG. 4), to a position shown in FIG. 5, then to a position shown in FIG. 6 and then to a position shown in FIG. 7. Similarly to the first embodiment, the transfer port 84 always communicates with a sleeve-like lands space 66 between the lands 62 and 64. The relief port 86 is covered by the land 64 of the spool 42 in the positions shown in FIGS. 4 and 5, but uncovered to communicate with the sleeve-like lands space 66 in the positions shown in FIGS. 6 and 7.

When the spool 42 is in the spring set position shown in FIG. 4, the port 102 of the branch passage 80 communicates with the sleeve-like lands space 66, while the other port 104 is covered by the land 64. When the spool 42 is in the position shown in FIG. 5 or 6, the port 102 of the branch passage 80 is out of communication with the sleeve-like lands space 66, while the port 104 is held covered by the land 64, Under this condition, the branch passage 80 is closed and the pressure therein is as high as that in the oil supply passage 36. When the spool 42 is in the position shown in FIG. 7, the port 104 of the branch passage 80 is uncovered by the land 64 to communicate with the sleeve-like lands space 66.

It is to be noted that the positions shown in FIGS. 4, 6 and 7 correspond to the positions shown in FIGS. 1, 2 and 3, respectively.

Figure 8:
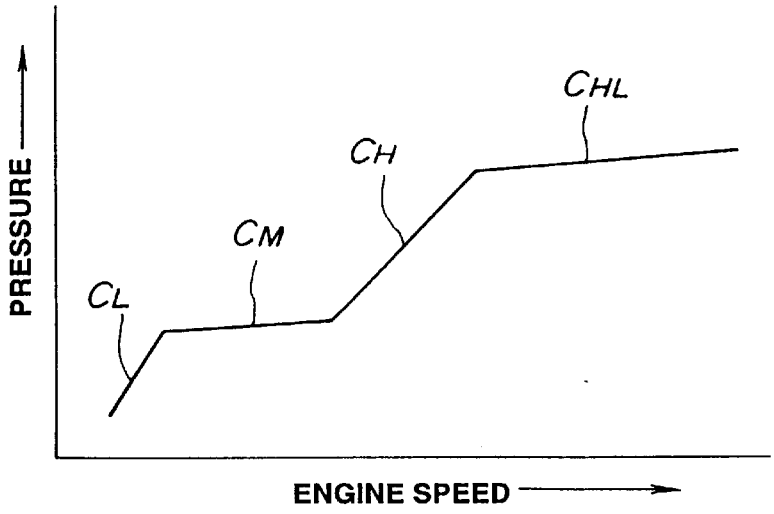
FIG. 8 is a diagram illustrating the delivery pressure vs. speed characteristic of the variable capacity pump shown in FIG. 4.

FIG. 8 shows pressure in the oil supply passage 36 increasing depending on the engine speed increase. The pressure increases is four stages as the regulator valve 100 corresponding to the four positions taken by the spool 42 of the regulator valve 100. With the position shown in FIG. 4, the first stage CL quick pressure increase is given. With the position shown in FIG. 5, the second stage CM slow pressure increase is given. With the position shown in FIG. 6, third stage CH progressive pressure increase is given with the position shown in FIG. 7, the fourth stage CHL pressure is given.

From the preceding description, it will now be appreciated that the regulator valves 40 and 100 are free from difficulty in manufacturing their parts since the spool 42 and the piston 44 are extremely simple in construction and not formed with any internal passage or passages.

What is claimed is:

1. A variable capacity pump, comprising:

a pump having an inlet port, a first outlet port, and a second outlet port, said pump transferring fluid supplied to said inlet port to be dispensed at said first outlet port and said second outlet port;

a fluid supply passage connected to said second outlet port uninterruptedly at one end thereof; and a regulator valve having a bore, a spool disposed in said bore and a return spring disposed in said bore and biasing said spool to a first position, said spool having spaced first and second lands, said first land of said spool defining in said bore a pressure chamber, said first and second lands of said spool defining therebetween and in said bore a predetermined space that is separated from said chamber by said first land, said regulator valve having a pressure admission port connected to said fluid supply passage and always opening to said pressure chamber, said regulator valve having a fluid escape passage connected at one end thereof to said fluid supply passage and at the other end thereof to said first outlet port of said pump and a one-way check valve disposed in said fluid escape passage to allow flow of fluid from said first outlet port to said fluid supply passage and to prevent flow of fluid to said first outlet port from said fluid supply passage, said one-way check valve dividing said fluid escape passage into a first section communicating with said fluid supply passage and a second section communicating with said first outlet port of said pump, said regulator valve having a transfer port connected to said second section of said fluid escape passage and thus to said first outlet port of said pump and a relief port connected to said inlet port of said pump, said regulator valve having a branch passage connected to said fluid supply passage, said branch passage having two spaced first and second ports, said first land of said spool being exposed to fluid pressure to urge said spool against said return spring for movement in such a predetermined direction within said bore as to expand in volume of said pressure chamber as the fluid pressure within said pressure chamber increases, said spool having second, third and fourth positions in addition to said first position over the entire movement of said spool against said return spring in response to fluid pressure within said pressure chamber, said first port of said branch passage being open to said bore and uncovered by said first land to communicate with said predetermined space when said spool is in said first position, said first port of said branch passage being prevented by said first land to communicate with said predetermined space when said spool is in said second, third or fourth positions, said second port of said branch passage being open to said bore and covered by said second land when said spool is in said first, second or third positions, said second port of said branch passage being uncovered by said second land to communicate with said predetermined space when said spool is in said fourth position, said transfer port being open to said bore and left uncovered by said first and second lands to communicate with said predetermined space when said spool is in said first, second, third or fourth positions, said relief port being open to said bore and covered by said second land when said spool is in said first or second positions, said relief port being uncovered by said second land to communicate with said predetermined space when said spool is in said third or fourth positions.

2. A variable capacity pump as claimed in claim 1, wherein said first port of said branch passage is covered by said first land when said spool is in said second position, and uncovered by said first land to communicate with said pressure chamber when said spool is in said third or fourth positions.

3. A variable capacity pump as claimed in claim 2, wherein said one-way check valve allows flow of fluid from said first outlet port to said fluid supply passage when said spool is in said second position.

4. A variable capacity pump, comprising:

a pump adapted to be driven by an engine having varying engine speeds, said pump having an inlet port, a first outlet port, and a second outlet port, said pump transferring fluid supplied to said inlet port to be displaced at said first outlet port and said second outlet port at a rate determined by the engine speeds;

a fluid supply passage connected to said second outlet port uninterruptedly at one end thereof;

a pressure regulator valve having a pressure admission port connected to said fluid supply passage, a branch passage connected to said fluid supply passage, a relief port, a transfer port, and a spool movable in response to fluid pressure at said pressure admission port;

a transfer passage connecting said first outlet port of said pump to said transfer port;

a relief passage connecting said relief port to said inlet port of said pump, wherein, when the engine speed is lower than or equal to a first predetermined value, said spool takes a first position in which fluid from said first outlet port of said pump is allowed to flow through said transfer port and said branch passage into said fluid supply passage, when the engine speed is higher than said first predetermined value but lower than or equal to a second predetermined value that is higher than said first predetermined value, said spool takes a second position in which fluid from said first outlet port is allowed to flow into said fluid supply passage, when the engine speed is higher than said second predetermined value but lower than or equal to a third predetermined value that is higher than said second predetermined value, said spool takes a third position in which said transfer port is connected to said relief port, allowing fluid from said first outlet port to flow through said transfer passage and said relief passage into said inlet port, and when the engine speed is higher than said third predetermined value, said spool takes a fourth position in which said branch passage is connected to said relief port with said transfer port left connected to said relief port, allowing a portion of fluid to flow from said fluid supply passage through said branch passage and said relief passage into said inlet port of said pump in addition to the flow of fluid from said first outlet port into said inlet port of said pump through said transfer passage and said relief passage.

5. A variable capacity pump as claimed in claim 4, further comprising a one-way check valve that is operative to allow flow of fluid from said first outlet port of said pump to said fluid supply passage when said spool takes said second position.

* * * * *